US011718090B2

(12) United States Patent
Ozaki et al.

(10) Patent No.: US 11,718,090 B2
(45) Date of Patent: Aug. 8, 2023

(54) LIQUID DISCHARGE HEAD, LIQUID DISCHARGE DEVICE, AND LIQUID DISCHARGE METHOD

(71) Applicant: TOSHIBA TEC KABUSHIKI KAISHA, Tokyo (JP)

(72) Inventors: Kei Ozaki, Sunto Shizuoka (JP); Shunichi Ono, Izu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 372 days.

(21) Appl. No.: 16/796,230

(22) Filed: Feb. 20, 2020

(65) Prior Publication Data

US 2020/0369026 A1 Nov. 26, 2020

(30) Foreign Application Priority Data

May 23, 2019 (JP) ..... 2019-097103

(51) Int. Cl.
*B41J 2/045* (2006.01)

(52) U.S. Cl.
CPC ..... *B41J 2/04551* (2013.01); *B41J 2/04505* (2013.01)

(58) Field of Classification Search
CPC ..... B41J 2/04551; B41J 2/04505
See application file for complete search history.

(56) References Cited

U.S. PATENT DOCUMENTS 6,273,540 B1 8/2001 Takamura et al.
9,533,495 B2 1/2017 Mogami
2016/0096364 A1* 4/2016 Suzuki ..... B41J 2/04568 347/12

FOREIGN PATENT DOCUMENTS

CN 105522823 A 4/2016

OTHER PUBLICATIONS

Chinese First Office Action dated Jul. 21, 2021, mailed in corresponding Chinese Patent Application No. 202010075720.X, 13 pages (with Translation).

* cited by examiner

*Primary Examiner* — Thinh H Nguyen
(74) *Attorney, Agent, or Firm* — Kim & Stewart LLP

(57) ABSTRACT

A liquid discharge head includes first and second groups of nozzles and first and second groups of actuators corresponding to the first and second groups of nozzles, respectively, and a head drive circuit. The head drive circuit is configured to receive a sequence of input data portions including first and second data portions, and select a setting mode between a first setting mode, in which the first group of actuators is driven based on the first input data portion and the second group of actuators is driven based on the second input data portion, and a second setting mode, in which the second group of actuators is driven based on the first input data portion and the first group of actuators is driven based on an input data portion that is after the first data portion in the sequence.

15 Claims, 5 Drawing Sheets

LIQUID DISCHARGE HEAD, LIQUID DISCHARGE DEVICE, AND LIQUID DISCHARGE METHOD

CROSS-REFERENCE TO RELATED APPLICATION

This application is based upon and claims the benefit of priority from Japanese Patent Application No. 2019-097103, filed on May 23, 2019, the entire contents of which are incorporated herein by reference.

FIELD

Embodiments described herein relate generally to a liquid discharge head, a liquid discharge device, and a liquid discharge method.

BACKGROUND

In a liquid discharge head used in a liquid discharge device or the like, data may be transmitted on a per column basis for each group of nozzle rows for simultaneous printing from all nozzles. That is, it is assumed that all the nozzles are divided into four groups of rows A to D, and printing is performed in order from the row A to the row D. In this case, transfer of print data starts from a nozzle of the preceding row A, is continued to the rows B and C, and ends at a nozzle of the subsequent row D. A control circuit of a driver or the like which receives print data is configured so that shift registers that receive print data corresponding one-to-one with the nozzle rows, based on the premise that the print data is transmitted in order from row A to row D. In addition, the control circuit performs control so that print data is output to a nozzle row before subsequent print data is output to the next nozzle row by storing the incoming print data in the shift registers in the order in which the print data are received.

The performance of nozzles at the end of a liquid discharge head tends to deteriorate more than ones away from the end. For this reason, in some cases, a liquid discharge head in which the ordering of nozzles is set without using nozzles at the end. For example, a liquid discharge head performing printing in order of a row C, a row D, a row A, and a row B can be made. In this case, it is desirable that print data are transmitted with print data for a row C first, then print data for a row D, then print data for a row A, and then print data for a row B. However, the control circuit may be configured such that print data are assumed to be transmitted in the standard sequence order of a row A to a row D. In this case, print data are transmitted to nozzles in rows different from the intended rows, for example, print data for row C is mistakenly supplied to a nozzle of row A.

DETAILED DESCRIPTION

In general, according to an embodiment, a liquid discharge head includes a first group of nozzles and a first group of actuators corresponding to the first group of nozzles, a second group of nozzles and a second group of actuators corresponding to the second group of nozzles, wherein each of the first and second groups of nozzles is arranged along a first direction, and the second group of nozzles is shifted with respect to the first group of nozzles in a second direction crossing the first direction, and a head drive circuit. The head drive circuit is configured to receive a sequence of input data portions including first and second data portions, and select a setting mode between a first setting mode, in which the first group of actuators is driven based on the first input data portion and the second group of actuators is driven based on the second input data portion, and a second setting mode, in which the second group of actuators is driven based on the first input data portion and the first group of actuators is driven based on an input data portion that is after the first data portion in the sequence.

Figure 1:
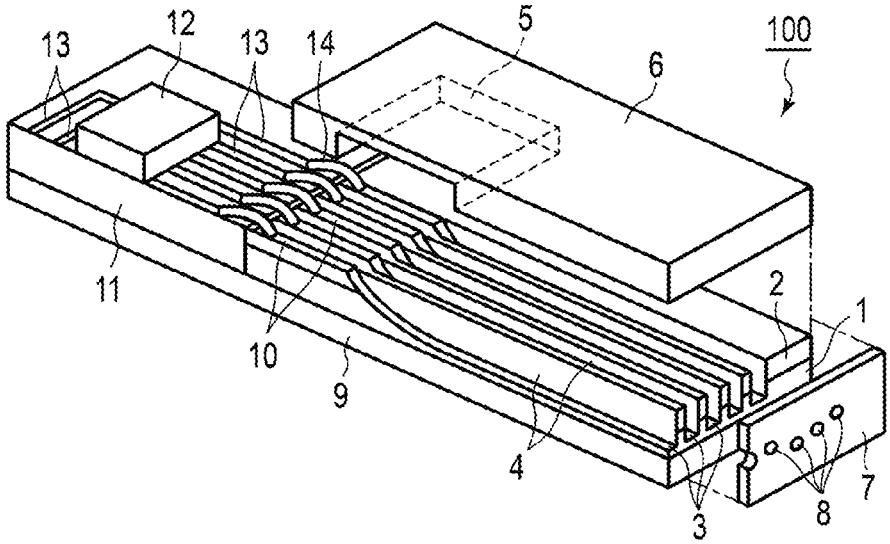
FIG. 1 illustrates an exploded perspective view of a part of a liquid discharge head according to one embodiment.
Figure 2:
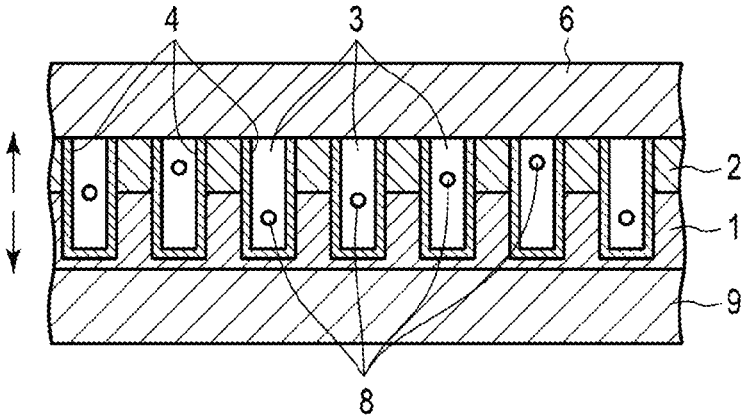
FIG. 2 illustrates a longitudinal cross-sectional view of a front portion of the liquid discharge head.
Figure 3:
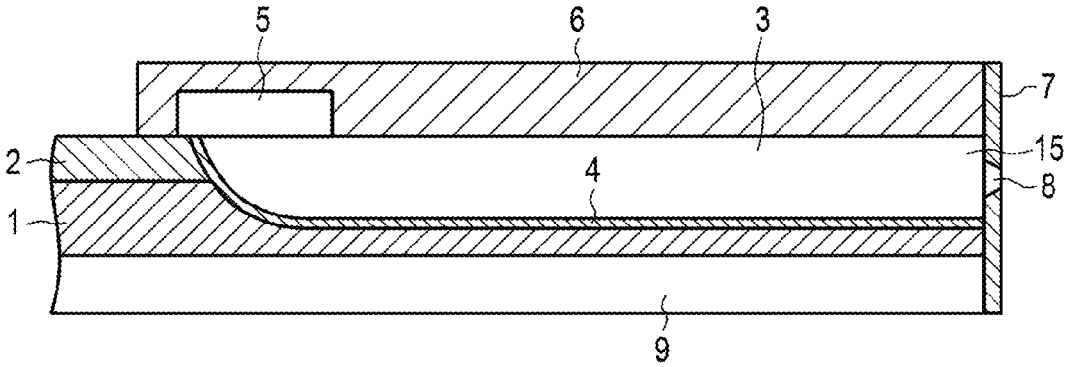
FIG. 3 illustrates a transverse cross-sectional view of a front portion of the liquid discharge head.

First, a configuration of a liquid discharge head according to an embodiment will be described using FIGS. 1 to 3. FIG. 1 illustrates an exploded perspective view of a part of a liquid discharge head 100 according to the embodiment. FIG. 2 illustrates a longitudinal cross-sectional view of a front portion of the liquid discharge head 100. FIG. 3 illustrates a transverse cross-sectional view of a front portion of the liquid discharge head 100.

The liquid discharge head 100 includes a base substrate 9. In the liquid discharge head 100, a first piezoelectric member 1 is joined to the upper surface of the base substrate 9 on a front side, and a second piezoelectric member 2 is joined onto the first piezoelectric member 1. The first piezoelectric member 1 and the second piezoelectric member 2 joined to each other are polarized in mutually opposite directions along a plate thickness direction as indicated by arrows of FIG. 2.

The material of the base substrate 9 has a small dielectric constant, and the difference in thermal expansion factor between the first piezoelectric member 1 and the second piezoelectric member 2 is small. The material of the base substrate 9 may be, for example, alumina ($Al_2O_3$), silicon nitride ($Si_3N_4$), silicon carbide (SiC), aluminum nitride (AlN), and lead zirconate titanate (PZT). In contrast, there is lead zirconate titanate (PZT), lithium niobate ($LiNbO_3$), and lithium tantalate ($LiTaO_3$) as the material of the first piezoelectric member 1 and the second piezoelectric member 2.

The liquid discharge head 100 has a large number of elongated grooves 3 from a distal side to a rear end side of the first piezoelectric member 1 and the second piezoelectric member 2 joined to each other. Each groove 3 is at a constant interval and is parallel to the other grooves 3. Each groove 3 is open at a distal end and inclined upward at a rear end.

The liquid discharge head 100 includes an electrode 4 on a side wall and a bottom surface of each groove 3. The electrode 4 has a two-layer structure of nickel (Ni) and gold (Au). The electrode 4 is uniformly formed in each groove 3, for example, through a plating method. The method for forming the electrode 4 is not limited to the plating method, and may be a sputtering method, a vapor deposition method, or the like.

The liquid discharge head 100 includes an extraction electrode 10 from the rear end of each groove 3 toward the upper surface of a rear portion of the second piezoelectric member 2. The extraction electrode 10 extends from the electrode 4.

The liquid discharge head 100 includes a top plate 6 and an orifice plate 7. The top plate 6 closes an upper portion of each groove 3. The orifice plate 7 closes the distal end of each groove 3. The liquid discharge head 100 forms a plurality of pressure chambers 15 using each groove 3 surrounded by the top plate 6 and the orifice plate 7. The pressure chambers 15 have a shape of a depth of 300 μm and a width of 80 μm and are arranged in parallel at a pitch of 169 μm, for example. Such a pressure chamber 15 is also referred to as an ink chamber. The pressure chamber 15 contains a liquid such as ink.

The top plate 6 includes a common ink chamber 5 on the inner rear side thereof. In the orifice plate 7, a nozzle 8 is formed at a position opposite to each groove 3. A nozzle 8 communicates with the opposite groove 3, that is, the pressure chamber 15. The nozzle 8 has a tapered shape from the pressure chamber 15 to an ink discharge side opposite to the pressure chamber side. Nozzles 8 corresponding to three adjacent pressure chambers 15 are considered as a set, and these nozzles 8 are formed at a constant interval while being deviated in a height direction (a vertical direction on the page of FIG. 2) of the grooves 3.

In the liquid discharge head 100, a printed substrate 11 on which a conductive pattern 13 is formed is joined to the upper surface of the base substrate 9 on a rear side. In the liquid discharge head 100, a drive IC 12 in which a head drive circuit 101 is mounted on the printed substrate 11. The drive IC 12 is connected to the conductive pattern 13. The conductive pattern 13 is coupled to each extraction electrode 10 with a conductive wire 14 through wire bonding.

A set of the pressure chambers 15, the electrodes 4, and the nozzles 8 included in the liquid discharge head 100 is referred to as a channel. That is, the liquid discharge head 100 has, for example, channels by the number N of the grooves 3.

Figure 4:
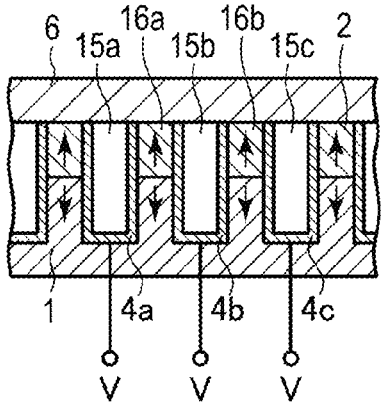
FIGS. 4-6 illustrate a behavior of the liquid discharge head during liquid discharge.
Figure 5:
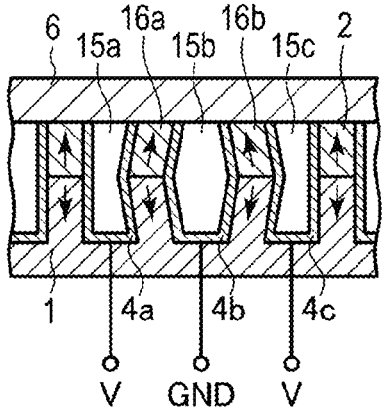
Figure 6:
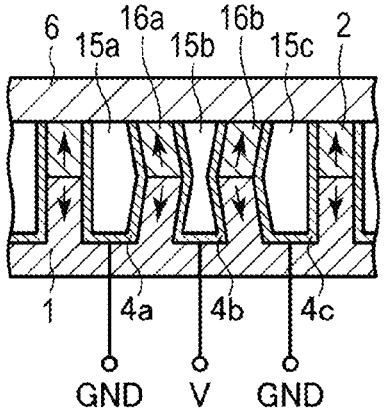

Next, an operation principle of the liquid discharge head 100 configured as described above will be described using FIGS. 4 to 6. FIGS. 4 to 6 illustrate a behavior of the liquid discharge head 100 during liquid discharge. Pressure chambers 15*a* to 15*c* are shown in FIGS. 4 to 6 as an example of the pressure chambers 15. In addition, an electrode 4 on the wall surface of the pressure chamber 15*a* is set to an electrode 4*a*, an electrode 4 on the wall surface of the pressure chamber 15*b* is set to an electrode 4*b*, and an electrode 4 on the wall surface of the pressure chamber 15*c* is set to an electrode 4*c*.

FIG. 4 shows a state in which positive voltages V are respectively applied to the electrodes 4*a* to 4*c*. In this state, all of the electrodes 4*a* to 4*c* are at the same potential, and therefore, there is no electric field applied to partition walls 16*a* and 16*b*. Accordingly, the partition wall 16*a* sandwiched between the pressure chamber 15*a* and the pressure chamber 15*b* adjacent to each other is not deformed. Similarly, the partition wall 16*b* sandwiched between the pressure chamber 15*b* and the pressure chamber 15*c* adjacent to each other is not deformed.

FIG. 5 shows a state in which a ground voltage GND is applied to the central electrode 4*b* and a positive voltage V is applied to the electrodes 4*a* and 4*c* on both sides adjacent to the central electrode. In this state, a potential difference is generated between the central electrode 4*b* and the electrodes 4*a* and 4*c* on both sides adjacent to the central electrode. Accordingly, an electric field is generated in the partition walls 16*a* and 16*b* due to the potential difference applied, and the partition walls 16*a* and 16*b* are shear-deformed outward so as to expand the volume of the pressure chamber 15*b*. If the volume of the pressure chamber 15*b* expands, the pressure of a liquid in the pressure chamber 15*b* decreases.

FIG. 6 shows a state in which a positive voltage V is applied to the central electrode 4*b* and a ground voltage GND is applied to the electrodes 4*a* and 4*c* on both sides adjacent to the central electrode. In this state, a potential difference opposite to that in FIG. 5 is generated between the central electrode 4*b* and the electrodes 4*a* and 4*c* on both sides adjacent to the central electrode. Accordingly, an electric field is generated in a direction opposite to that in FIG. 5 in the partition walls 16*a* and 16*b* due to the potential difference applied, and the partition walls 16*a* and 16*b* are shear-deformed inward so as to contract the volume of the pressure chamber 15*b*. If the volume of the pressure chamber 15*b* contracts, the pressure of a liquid in the pressure chamber 15*b* increases.

If the volume of the pressure chamber 15*b* expands or contracts, pressure vibration is generated in the pressure chamber 15*b*. The pressure in the pressure chamber 15*b* increases due to the pressure vibration, and ink droplets (or, more broadly, liquid droplets) are discharged from the nozzle 8 communicating with the pressure chamber 15*b*.

As described above, the partition walls 16*a* and 16*b* are an example of an actuator configured to change the volume of the pressure chamber 15*b* having the partition walls 16*a* and 16*b* as wall surfaces. That is, each pressure chamber 15 shares the pressure chambers 15 adjacent to each other and the actuator. For this reason, the head drive circuit 101 cannot drive each pressure chamber 15 individually. Accordingly, the head drive circuit 101 performs n-division driving by dividing the pressure chambers 15 into every (n−1) groups. In this contest, n is an integer of 2 or more. The present embodiment describes a non-limiting example case of so-called four-division driving in which every third pressure chamber 15 is division-derived while setting four pressure chambers as a set. The four-division driving is merely one example, and 2-, 3-, or 5- or more division driving may be employed.

The method for applying a voltage for discharging ink from the nozzle corresponding to the central pressure chamber 15*b* is not limited to the examples of FIGS. 4 to 6. For example, the liquid discharge head 100 may be in a state where the pressure chamber 15*b* is not deformed by applying the same voltage (for example, ground voltage GND) to the electrodes 4*a* to 4*c*. For example, in the liquid discharge head 100, the volume of the pressure chamber 15*b* may be expanded by applying a negative voltage −V to the central electrode 4*b* and a ground voltage GND to the electrodes 4*a* and 4*c* on both sides adjacent to the central electrode. For example, in the liquid discharge head 100, the volume of the pressure chamber 15*b* may be expanded by applying a negative voltage −V/2 to the central electrode 4*b* and a positive voltage V/2 to the electrodes 4*a* and 4*c* on both sides adjacent to the central electrode. For example, in the liquid discharge head 100, the volume of the pressure chamber 15*b* may be contracted by applying a ground voltage GND to the central electrode 4*b* and a negative voltage −V to the electrodes 4*a* and 4*c* on both sides adjacent to the central electrode. For example, in the liquid discharge head 100, the volume of the pressure chamber 15*b* may be contracted by applying a positive voltage V/2 to the central electrode 4*b* and a negative voltage −V/2 to the electrodes 4*a* and 4*c* on both sides adjacent to the central electrode.

Figure 7:
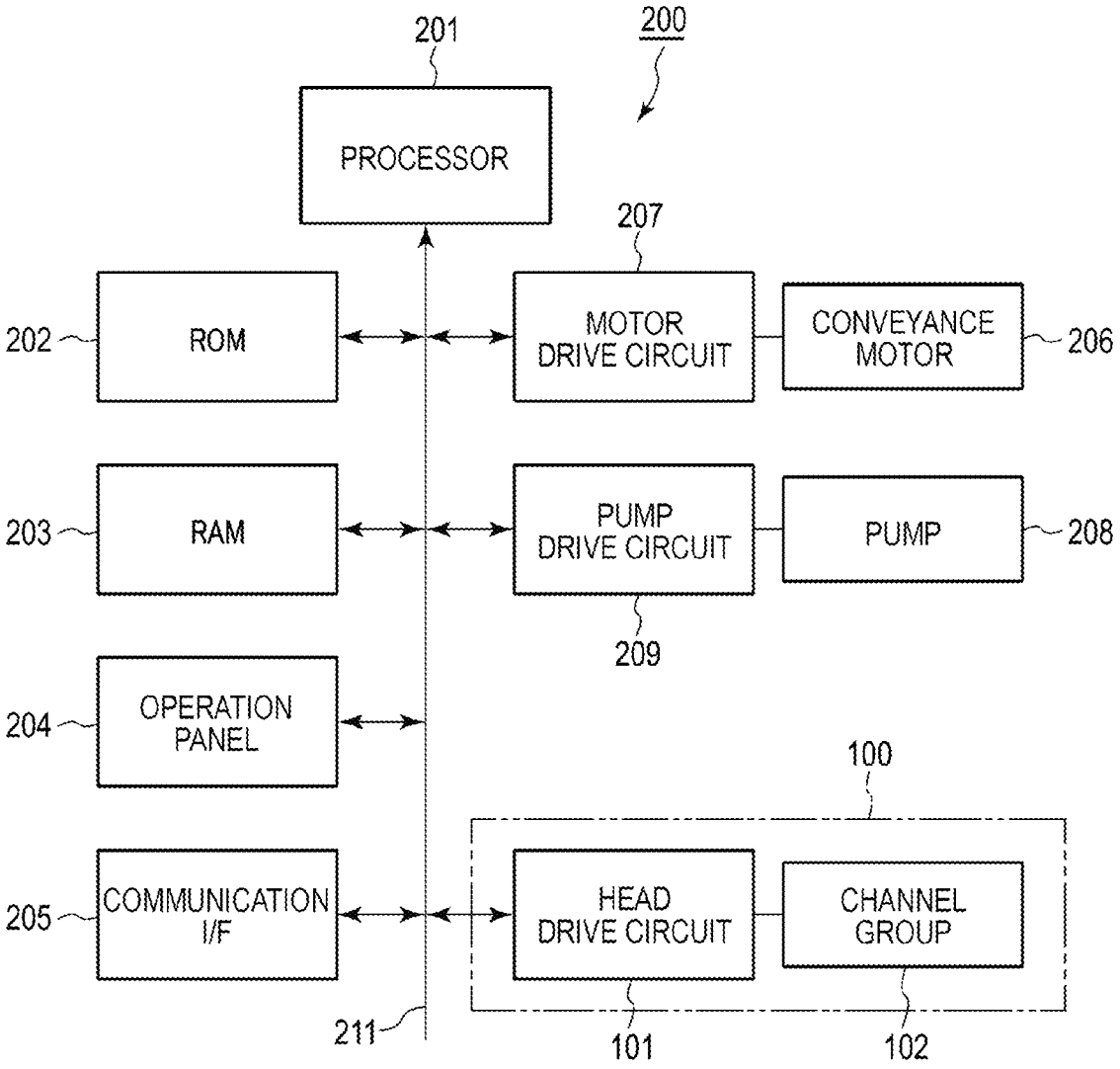
FIG. 7 is a block diagram illustrating an example of a configuration of a liquid discharge device according to the embodiment.

Next, a configuration of a liquid discharge device 200 will be described using FIG. 7. FIG. 7 is a block diagram illustrating an example of the configuration of the liquid discharge device 200.

The liquid discharge device 200 is, for example, an ink jet printer. The liquid discharge device 200 forms an image by discharging ink or the like onto an image forming medium, such as a sheet of paper. The liquid discharge device 200 achieves gradation expression by changing the amount of liquid droplets landed on each pixel.

The liquid discharge device 200 includes a processor 201, a read-only memory (ROM) 202, a random-access memory (RAM) 203, an operation panel 204, a communication interface 205, a conveyance motor 206, a motor drive circuit 207, a pump 208, a pump drive circuit 209, and the liquid discharge head 100. In addition, the liquid discharge device 200 includes a busline 211 such as an address bus or a data bus. In the liquid discharge device 200, the processor 201, the ROM 202, the RAM 203, the operation panel 204, the communication interface 205, the motor drive circuit 207, the pump drive circuit 209, and the head drive circuit 101 of the liquid discharge head 100 are connected to the busline 211 directly or through an input and output circuit.

The processor 201 corresponds to a central functional component of a computer. The processor 201 controls each component of the computer so as to perform various functions of the liquid discharge device 200 according to an operating system or an application program. The processor 201 is, for example, a central processing unit (CPU).

The ROM 202 corresponds to a main memory portion of the above-described computer. The ROM 202 stores the above-described operating system or application program. The ROM 202 stores data necessary for the processor 201 to execute processing for controlling each portion, in some cases.

The RAM 203 corresponds to main memory of the above-described computer. The RAM 203 stores data necessary for the processor 201 to execute processing. In addition, the RAM 203 is also used as a work area where information is appropriately rewritten by the processor 201. The work area includes an image memory in which print data is developed.

The operation panel 204 includes an operation unit and a display unit. Function keys such as a power key, a paper feed key, and an error release key are disposed in the operation unit. The display unit can display various states of the liquid discharge device 200.

The communication interface 205 receives print data from a client terminal connected thereto through a network such as a local area network (LAN). If an error occurs in the liquid discharge device 200, the communication interface 205 transmits a signal to the client terminal to notify the error.

The motor drive circuit 207 controls driving of the conveyance motor 206. The conveyance motor 206 functions as a driving source of a conveyance mechanism that conveys an image forming medium. If the conveyance motor 206 is driven, the conveyance mechanism starts conveying an image forming medium. The conveyance mechanism conveys an image forming medium to a position at which it can be printed by the liquid discharge head 100. The conveyance mechanism discharges the printed image forming medium from a discharge port to the outside of the liquid discharge device 200.

The pump drive circuit 209 controls driving of the pump 208. When the pump 208 is driven, ink in an ink tank is supplied to the liquid discharge head 100.

The liquid discharge head 100 discharges liquid droplets on to the image forming medium based on the received print data. The liquid discharge head 100 includes the head drive circuit 101, a channel group 102, and the like.

Figure 8:
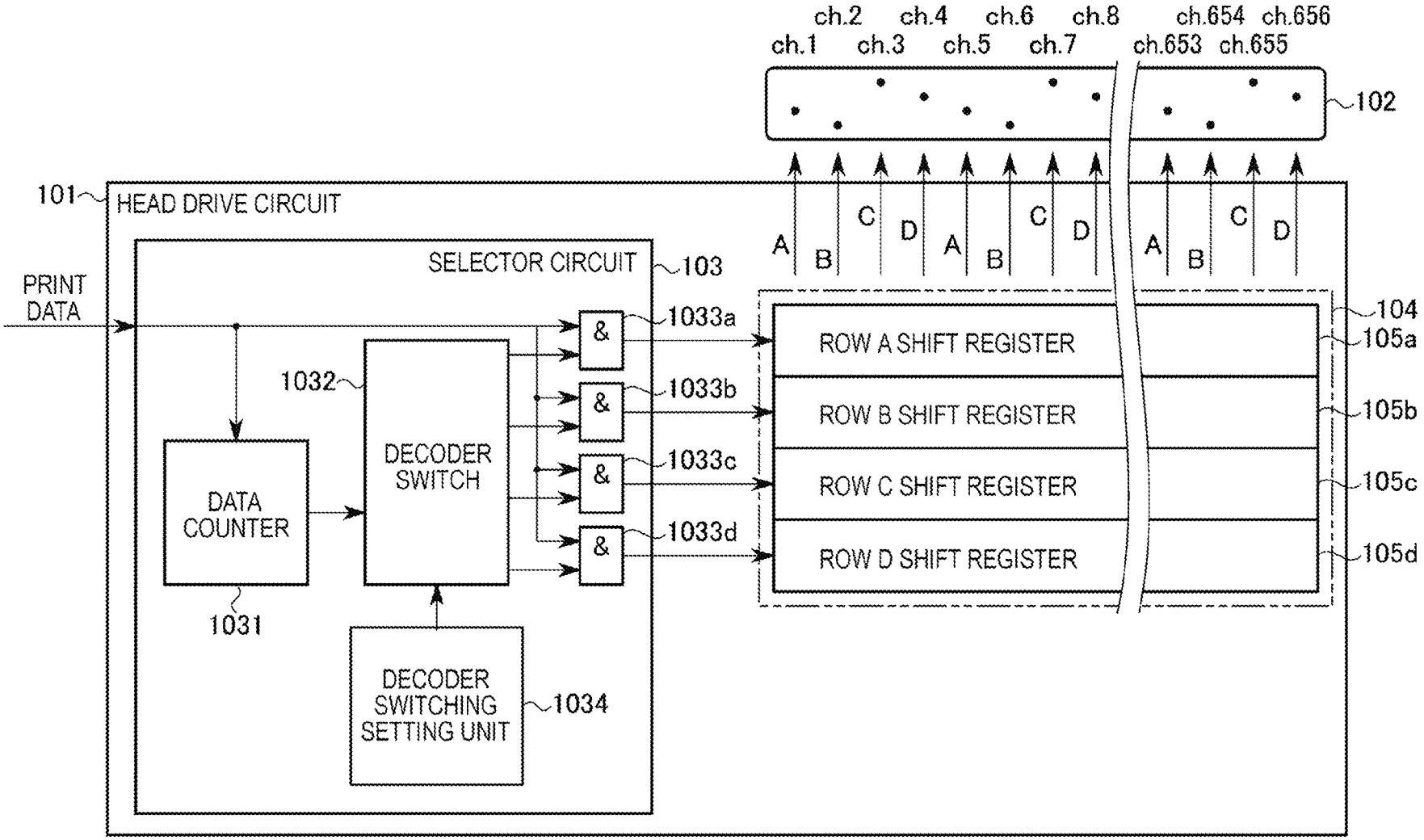
FIG. 8 is a block diagram illustrating an example of a configuration of a head drive circuit in FIG. 7.

FIG. 8 is a block diagram illustrating an example of a configuration of the head drive circuit 101. As described above, the head drive circuit 101 is in the drive IC 12.

The head drive circuit 101 drives the channel group 102 of the liquid discharge head 100 based on the print data. The head drive circuit 101 supplies a drive signal to the channel group 102.

The channel group 102 includes a plurality of channels (ch. 1, ch. 2, . . . ch. N (where N is an integer of n or more)) including the pressure chambers 15, the electrodes 4, and the nozzles 8. That is, the channel group 102 discharges droplets through an operation of each pressure chamber 15, which is expanded and contracted by an actuator 16, based on a control signal from the head drive circuit 101. The present embodiment describes a case where N=656 as an example. The liquid discharge head 100 may include more than 656 nozzles 8. In this example, the liquid discharge head 100 discharges a liquid from the N nozzles using the N nozzles as channels but without using one or more nozzles 8 close to an end. The reason for this is to improve the image quality by not using nozzles 8 (those at/near an end) with low performance since the performance of the nozzles 8 close to the end tends to be low.

The channel group 102 is divided into n types of rows. In the present embodiment, the channel group 102 is divided into four types of rows A to D. In the channel group 102, four types of rows are repeatedly lined up in the same array as that of, for example, a row A, a row B, a row C, a row D, a row A, a row B, and so on. For example, in the channel group 102 of the present embodiment, ch. 1, ch. 2, ch. 3, ch. 4, ch. 5, ch. 6, and so on are respectively lined up in order of a row A, a row B, a row C, a row D, a row A, a row B, and so on. That is, in the present embodiment, ch. (4m+1) is a row A, ch. (4m+2) is a row B, ch. (4m+3) is a row C, and ch. (4m+4) is a row D. Here, m is an integer of 0 or more. To generalize it, ch. (n·m+1) is a row A, ch. (n·m+2) is a row B, ch. (n·m+3) is a row C, ch. (n·m+4) is a row D, and so on. The channel group 102 is an example of a discharge unit configured to discharge a liquid.

As described above, the nozzles 8 are deviated in sequencing. For example, in the present embodiment, row C is the first row, row D and the row A follow thereafter, and row B is the last row. Accordingly, if a liquid is not discharged in the order of row C, row D, row A, and row B, an image to be printed will not be correctly printed. For this reason, print data needs to be input to the channel group 102 in the order of print data for row C, print data for row D, print data for row A, and then print data for row B.

The head drive circuit 101 includes, for example, a selector circuit 103 and a shift register group 104.

The selector circuit 103 is a circuit configured to determine and allocate an output destination of input data. The selector circuit 103 includes, for example, a data counter 1031, a decoder switch 1032, n AND circuits 1033, and a decoder switching setting unit 1034. Four AND circuits 1033, which are AND circuit 1033*a* to AND circuit 1033*d*, are shown in FIG. 8 as an example.

The data counter 1031 counts the number of data input to the selector circuit 103. Accordingly, the data counter 1031 prevents overflow and determines the timing for switching an output destination of data using the decoder switch 1032.

The decoder switch 1032 is a circuit configured to determine an output destination of data input to the selector circuit. The decoder switch 1032 switches the output destination of data in response to whether the counted number of the data counter 1031 becomes a predetermined number. The decoder switch 1032 inputs a signal indicating a value of 1 to any one of the AND circuits 1033*a, b, c*, or *d*, which is set as an output destination of data input to the selector circuit 103, among the n AND circuits 1033*a, b, c*, or *d*. The decoder switch 1032 inputs a signal indicating a value of 0 to the other (n−1) AND circuits. The decoder switch 1032 determines, for example, to which AND circuit the signal indicating the value of 1 is input in response to the header value of the data input to the selector circuit 103 and output destination setting (a setting mode).

The selector circuit 103 includes, for example, four AND circuits: AND circuit 1033*a* to AND circuit 1033*d*. The AND circuit 1033*a* corresponds to the row A, the AND circuit 1033*b* corresponds to the row B, the AND circuit 1033*c* corresponds to the row C, and the AND circuit 1033*d* corresponds to the row D. Each of AND circuits 1033*a, b, c, d* outputs 1 if the signal value input from the decoder switch is 1 and the data value input to the selector circuit 103 is 1. The AND circuits 1033*a, b, c, d*, output 0 if at least one of the signal value input from the decoder switch or the data value input to the selector circuit 103 is 0. Accordingly, the AND circuits 1033*a, b, c, d* output data input to the selector circuit 103 as it is if the signal input from the decoder switch is 1. The AND circuits 1033*a, b, c, d* output 0 regardless of data input to the selector circuit 103 if the signal value input from the decoder switch is 0. As described above, the decoder switch 1032 and the four AND circuits 1033 cooperate with each other to output data input to the selector circuit to any one of a row A shift register 105*a*, a row B shift register 105*b*, a row C shift register 105*c*, or a row D shift register 105*d*.

The decoder switch 1032 and the AND circuits 1033*a, b, c, d* cooperate with each other to function as an output unit configured to output input data to output destinations corresponding to the types of data based on output destination setting.

The decoder switching setting unit 1034 is a circuit, a storage device, or the like configured to store the output destination setting that indicates to which AND circuit 1033 the decoder switch 1032 outputs a signal of a value of 1. The output destination setting correlates, for example, a specific length value with an AND circuit 1033(*a, b, c*, or *d*). In the output destination setting, a value 00, a value 01, a value 10, and a value 11 are respectively correlated with the AND circuit 1033*c*, the AND circuit 1033*d*, the AND circuit 1033*a*, and the AND circuit 1033*b*, for example. In this case, the decoder switch 1032 inputs a signal indicating a value of 1 to the AND circuit 1033*c* if the header value is 00, to the AND circuit 1033*d* if the header value is 01, to the AND circuit 1033*a* if the header value is 10, and to the AND circuit 1033*b* if the header value is 11. That is, data of which the header value is 00 is output to the AND circuit 1033*c*, data of which the header value is 01 is output to the AND circuit 1033*d*, data of which the header value is 10 is output to the AND circuit 1033*a*, and data of which the header value is 11 is output to the AND circuit 1033*b*. In the output destination setting, n types of data having different header values are correlated one-to-one with the n output destinations without overlapping.

The output destination setting is set, for example, during manufacturing of the liquid discharge head 100.

The decoder switching setting unit 1034 is an example of a correlation unit configured to correlate n types of print data with a certain AND circuit 1033(*a, b, c*, or *d*), one-to-one among n output destinations without overlapping.

Figure 9:
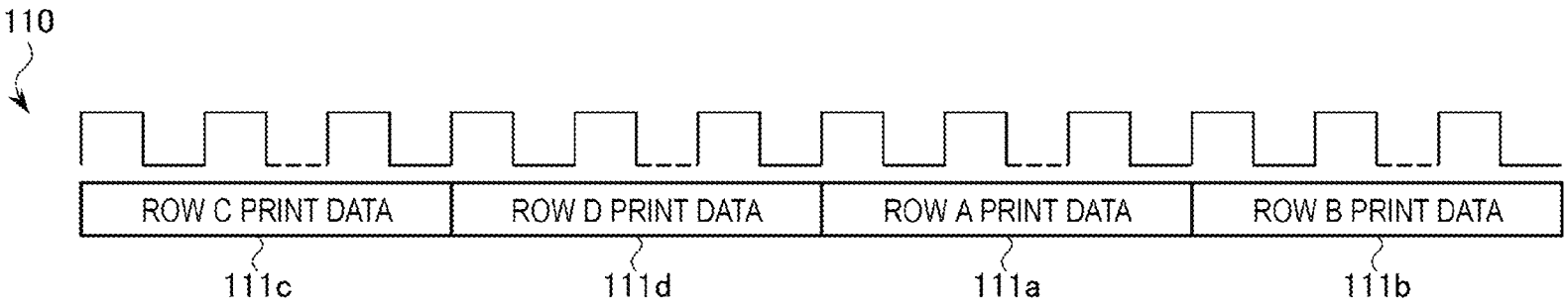
FIG. 9 schematically illustrates a configuration of print data according to the embodiment.

Data input to the selector circuit 103 will be described based on FIG. 9. FIG. 9 schematically illustrates a configuration of print data 110.

The print data 110 is data input to the selector circuit 103. The print data 110 is data for making the channel group print an image to be printed. The print data 110 is data indicating the discharge content of each channel. The print data 110 is serial data.

The print data 110 contains n row print data 111. The print data 110 of the present embodiment contains, as shown in FIG. 9, four row print data 111 which are row A print data 111*a*, row B print data 111*b*, row C print data 111*c*, and row D print data 111*d*. The rows corresponding to the row print data 111 are lined up in the same order as that of the rows corresponding to ch. 1 to ch. N. For example, if ch. 1, ch. 2, ch. 3, and ch. 4 respectively correspond to a row C, a row D, a row A, and a row B, the array of the rows corresponding to ch. 1 to ch. 4 is in order of the row C, the row D, the row A, and the row B. Accordingly, the array of the rows corresponding to the row print data 111 is also in order of the row C, the row D, the row A, and the row B. That is, the print data 110 contains, row print data 111 in order of row C print data 111*c*, row D print data 111*d*, row A print data 111*a*, and row B print data 111*b*.

The row A print data 111*a*, the row B print data 111*b*, the row C print data 111*c*, and the row D print data 111*d* respectively correspond to the row A, the row B, the row C, and the row D. The row print data 111 is serial data. The row print data 111 contains a header. The header is, for example, a value having a specific length. The header is, for example, a value in a range of 00 to 11 with 2 bits. The row print data 111 contain headers of predetermined values. The values correspond to different rows for each value. For example, it is determined that the value being 00 corresponds to the row A, the value being 01 corresponds to the row B, the value being 10 corresponds to the row C, and the value being 11 corresponds to the row D.

The shift register group 104 includes n shift registers. The shift register group 104 in FIG. 8 includes four shift registers. which are the row A shift register 105*a*, the row B shift register 105*b*, the row C shift register 105*c*, and the row D shift register 105*d*. The row A shift register 105*a*, the row B shift register 105*b*, the row C shift register 105*c*, and the row D shift register 105*d* respectively correspond to the row A, the row B, the row C, and the row D.

The shift registers 105(*a, b, c, d*), convert the row print data 111 as serial data into parallel data and output the converted parallel data to channels of the corresponding rows. For example, in the case of the row A shift register 105*a*, the row print data 111 converted into parallel data is output to channels (ch. 1, ch. 5, ch. 9, and so on) corresponding to the row A.

The liquid discharge head in the related art does not include the decoder switching setting unit 1034. For example, it is assumed that the decoder switch 1032 allows the channel group 102 to perform printing correctly if the row A is the first row, the row B and the row C follow thereafter, and the row D is the last row. That is, the decoder switch 1032 in a first setting mode inputs a signal indicating a value of 1 to the AND circuit 1033*a* if the header value is 00, to the AND circuit 1033*b* if the header value is 01, to the AND circuit 1033*c* if the header value is 10, and to the AND circuit 1033*d* if the header value is 11. In this case, the print data are correctly input to the channel group 102 if the print data are lined up in order of the row A print data 111*a*, the row B print data 111*b*, the row C print data 111*c*, and the row D print data 111*d*. However, if it is assumed that the row C is the first row, the row D and the row A follow thereafter, and the row B is the last row in the channel group 102 without using two nozzles 8 at the end, for example. In this case, even though the liquid needs to be discharged in order of the row C, the row D, the row A, and the row B, a liquid is discharged in order of the row A, the row B, the row C, and the row D if the print data lined up in order of the row A print data 111*a*, the row B print data 111*b*, the row C print data 111*c*, and the row D print data 111*d* is input to the selector circuit. In addition, if print data lined in order of the row C print data 111*c*, the row D print data 111*d*, the row A print data 111*a*, and the row B print data 111*b* is input to the selector circuit similarly to the embodiment, row C print data is input thereto instead of row A print data, row D print data is input thereto instead of row B print data, row A print data is input thereto instead of row C print data, and row B print data is input thereto instead of row D print data. In the related art, it is not possible to cope with the case where the array of the nozzles of the channel group 102 is deviated in the liquid discharge head after an initial setting/ordering.

In contrast, according to the liquid discharge device 200 of the embodiment, the liquid discharge head 100 can change the correlation between a header value and an AND circuit 1033(*a, b, c*, or *d*), from which data is output, by changing the output destination setting (change of setting mode). Accordingly, in the liquid discharge head 100 of the embodiment, data are correctly input to each channel simply by changing the output destination setting regardless of the array of the rows of the nozzles 8 of the channel group 102.

In addition, according to the liquid discharge device 200 of the embodiment, the output destination setting correlates a header value of data with the output destination of the data. Accordingly, the output destination of data can be simply changed by changing this correlation.

The above-described embodiment can be modified as follows. The head drive circuit 101 may be outside the liquid discharge head 100.

In the above-described embodiment, the pressure chambers 15 are continuously arranged in the liquid discharge device 200. However, the liquid discharge device of the embodiment may include an air chamber. In this case, pressure chambers and air chambers are alternately arranged in the liquid discharge device of the embodiment, for example.

The liquid discharge head 100 may have, in addition to the above-described embodiment, a structure or the like configured to discharge ink, for example, by deforming a vibration plate with static electricity. In this case, the vibration plate is an actuator configured to change the pressure of a liquid in a pressure chamber 15.

The liquid discharge device 200 is an ink jet printer configured to form a two-dimensional image on an image forming medium using ink. However, the liquid discharge device of the present disclosure is not limited thereto. The liquid discharge device may be, for example, a 3D printer, an industrial manufacturing machine, or a medical machine. If the liquid discharge device is a 3D printer, an industrial manufacturing machine, a medical machine, or the like, the liquid discharge device of an embodiment forms, for example, a three-dimensional object by discharging a molding material, a binder for solidifying the molding material, or the like from an ink jet head or the like.

In addition, the liquid discharge device 200 can discharge transparent glossy ink, ink that develops color when exposed to infrared rays or ultraviolet rays, other special ink types, or the like. Furthermore, the liquid discharge device 200 may discharge a liquid other than ink. The liquid which the liquid discharge device 200 discharges may be a dispersion liquid such as a suspension. Examples of the liquid other than ink which the liquid discharge device 200 can discharge include a liquid containing conductive particles for forming a wiring pattern on a printed wiring board, a liquid containing biological cells or the like for artificially forming tissue or organs, a binder such as an adhesive, wax, or a liquid-like resin.

While a certain embodiment has been described, the embodiment has been presented by way of example only, and is not intended to limit the scope of invention. Indeed, the novel embodiment described herein may be embodied in a variety of other forms; furthermore, various omissions, substitutions and changes in the form of the embodiment described herein may be made without departing from the spirit of the inventions. The accompanying claims and their equivalents are intended to cover such forms or modifications as would fall within the scope and spirit of the inventions.

What is claimed is:

1. A liquid discharge head, comprising:

a first group of nozzles and a first group of actuators corresponding to the first group of nozzles;

a second group of nozzles and a second group of actuators corresponding to the second group of nozzles, wherein each of the first and second groups of nozzles is arranged along a first direction, and the second group of nozzles is shifted with respect to the first group of nozzles in a second direction crossing the first direction; and a head drive circuit configured to:

receive a sequence of input data portions including first and second data portions; and select a setting mode between a first setting mode, in which the first group of actuators is driven based on the first input data portion and not on any of the second input data portion, and the second group of actuators is driven based on the second input data portion and not on any of the first input data portion, and a second setting mode, in which the second group of actuators is driven based on the first input data portion and not on any of the second input data portion, and the first group of actuators is driven based on an input data portion that is after the first data portion in the sequence and not on any of the first input data portion.

2. The liquid discharge head according to claim 1, wherein the head drive circuit is further configured to cause an input data portion having a first header value to be output to the first group of actuators during the first setting mode, and to cause the input data portion having the first header value to be output to the second group of actuators during the second setting mode.

3. The liquid discharge head according to claim 2, wherein the head drive circuit is further configured to cause an input data portion having a second header value to be output to the second group of actuators during the second setting mode, and to cause an input data portion having a header value different from the first header value to be output to the first group of actuators during the second setting mode.

4. The liquid discharge head according to claim 3, wherein the header value different from the first header value is equal to a third header value.

5. The liquid discharge head according to claim 4, wherein the second header value is different from the third header value.

6. The liquid discharge head according to claim 1, wherein the first group of nozzles and the second group of nozzles are alternately arranged in the first direction.

7. The liquid discharge head according to claim 1, wherein the first group of the actuators partially overlaps the second group of actuators.

8. The liquid discharge head according to claim 1, wherein the head drive circuit includes a setting switch circuit configured to switch the setting mode between the first setting mode and to the second setting mode.

9. A printer, comprising:

a media conveyer to convey a medium; and a print head configured to discharge ink onto the medium conveyed by the medium conveyer, the print head comprising:

a first group of nozzles and a first group of actuators corresponding to the first group of nozzles;

a second group of nozzles and a second group of actuators corresponding to the second group of nozzles, wherein each of the first and second groups of nozzles is arranged along a first direction, and the second group of nozzles is shifted with respect to the first group of nozzles in a second direction crossing the first direction; and a head drive circuit configured to:

receive a sequence of input data portions including first and second data portions; and select a setting mode between a first setting mode, in which the first group of actuators is driven based on the first input data portion and not on any of the second input data portion, and the second group of actuators is driven based on the second input data portion and not on any of the first input data portion, and a second setting mode, in which the second group of actuators is driven based on the first input data portion and not on any of the second input data portion, and the first group of actuators is driven based on an input data portion that is after the first data portion in the sequence and not on any of the first input data portion.

10. The printer according to claim 9, wherein the head drive circuit is further configured to cause a input data portion having a first header value to be output to the first group of actuators during the first setting mode, and to cause the input data portion having the first header value to be output to the second group of actuators during the second setting mode.

11. The printer according to claim 10, wherein the head drive circuit is further configured to cause an input data portion having a second header value to be output to the second group of actuators during the second setting mode, and to cause an input print data portion having a header value different from the first header value to be output to the first group of actuators during the second setting mode.

12. The printer according to claim 11, wherein the header value different from the first header value is equal to a third header value.

13. The printer according to claim 12, wherein the second header value is different from the third header value.

14. A method for driving a liquid discharge head including a first group of the actuators corresponding to a first group of nozzles and a second group of the actuators corresponding to a second group of nozzles, the method comprising:

receiving a sequence of input data portions including first and second data portions;

driving the first and second groups of actuators in a first setting mode, in which the first group of actuators is driven based on the first input data portion and not on any of the second input data portion, and the second group of actuators is driven based on the second input data portion and not on any of the first input data portion; and driving the first and second groups of actuators in a second setting mode, in which the second group of actuators is driven based on the first input data portion and not on any of the second input data portion and the first group of actuators is driven based on an input data portion that is after the first data portion in the sequence and not on any of the first input data portion.

15. The method according to claim 14, further comprising:

switching between the first and second setting modes.

* * * * *